US010113550B2

(12) United States Patent
Zakula et al.

(10) Patent No.: US 10,113,550 B2
(45) Date of Patent: Oct. 30, 2018

(54) VENTILATION SYSTEM AND METHOD

(75) Inventors: Mirko Zakula, New Berlin, WI (US); Robert G. Penlesky, Waukesha, WI (US); Daniel L. Karst, Beaver Dam, WI (US)

(73) Assignee: Broan-NuTone LLC, Hartford, WI (US)

( * ) Notice: Subject to any disclaimer, the term of this patent is extended or adjusted under 35 U.S.C. 154(b) by 1040 days.

(21) Appl. No.: 13/597,174

(22) Filed: Aug. 28, 2012

(65) Prior Publication Data

US 2014/0065945 A1 Mar. 6, 2014

(51) Int. Cl.

| | |
|---|---|
| ***F04D 25/06*** | (2006.01) |
| ***F04D 25/14*** | (2006.01) |
| ***F04D 29/62*** | (2006.01) |
| ***F04D 17/16*** | (2006.01) |
| *F24F 7/06* | (2006.01) |
| *F24F 7/00* | (2006.01) |

(52) U.S. Cl.

CPC ..... *F04D 25/0606* (2013.01); *F04D 17/16* (2013.01); *F04D 25/14* (2013.01); *F04D 29/626* (2013.01); *F24F 7/06* (2013.01); *F24F 2007/001* (2013.01); *Y10T 29/49826* (2015.01)

(58) Field of Classification Search

CPC . F24F 2007/001; F24F 7/007; F04D 25/0606; F04D 25/14

USPC ..... 454/349, 354

See application file for complete search history.

(56) References Cited

U.S. PATENT DOCUMENTS 2,800,849 A * 7/1957 Spear ..... F24F 13/20 292/80
6,585,486 B2 * 7/2003 Birdsell ..... H02G 3/086 415/213.1
7,203,416 B2 4/2007 Craw et al.
(Continued)

FOREIGN PATENT DOCUMENTS

CN 101025164 A 8/2007
HK 1207899 A1 2/2016
(Continued)

OTHER PUBLICATIONS

KIPO Search Report and Written Opinion dated Nov. 18, 2013 for corresponding Application No. PCT/US2013/054539.
(Continued)

*Primary Examiner* — Steven B McAllister
*Assistant Examiner* — Samantha Probst
(74) *Attorney, Agent, or Firm* — Barnes & Thornburg LLP

(57) ABSTRACT

Embodiments of the invention provide a ventilation exhaust fan comprising a main housing adapted to interchangeably receive a upgrade cartridge assembly. The main housing can include a fluid inlet through which fluid is received within the main housing, and a fluid outlet through which fluid exits the main housing. The ventilation exhaust fan can be installed in a structure in place of an existing ventilation exhaust fan assembly. The main housing can provide support to a scroll and a blower wheel positioned within the scroll. A motor may be nestled within the scroll and coupled to the blower wheel. A capacitor including a motor harness and plug can be electrically coupled with the motor. Electrical power can be supplied to the capacitor and motor to cause the motor to rotate the blower wheel to generate a flow of fluid out of the fluid outlet.

13 Claims, 15 Drawing Sheets

(56) References Cited

U.S. PATENT DOCUMENTS

| | | | | |
|---|---|---|---|---|
| 7,455,500 | B2 | 11/2008 | Penlesky et al. | |
| 8,210,806 | B2 | 7/2012 | Yang et al. | |
| 8,992,035 | B2 | 3/2015 | Zhong et al. | |
| 2005/0111840 | A1 | 5/2005 | Craw et al. | |
| 2006/0073008 | A1 | 4/2006 | Penlesky et al. | |
| 2008/0261508 | A1* | 10/2008 | Deng | F24F 7/06 454/354 |
| 2009/0170421 | A1 | 7/2009 | Adrian et al. | |
| 2011/0008159 | A1* | 1/2011 | Masuda | F04D 25/12 415/203 |
| 2012/0164936 | A1* | 6/2012 | Gao | F24F 7/007 454/341 |

FOREIGN PATENT DOCUMENTS

| | | | |
|---|---|---|---|
| JP | 2009-527719 | A | 7/2009 |
| JP | 2009527719 | A | 7/2009 |
| JP | 04566665 | B2 | 10/2010 |
| JP | 4566665 | B2 | 10/2010 |
| WO | WO-2014035651 | A1 | 3/2014 |

OTHER PUBLICATIONS

"Canadian Application Serial No. 2,850,648, Office Action dated Oct. 26, 2015", 5 pgs.

"International Application Serial No. PCT/US2013/054539, International Preliminary Report on Patentability dated Mar. 12, 2015", 10 pgs.

"International Application Serial No. PCT/US2013/054539, Response filed Jan. 14, 2014 to Written Opinion dated Nov. 18, 2013", 7 pgs.

"Canadian Application Serial No. 2,850,648, Response filed Apr. 26, 2016 to Office Action dated Oct. 26, 2015", 12 pgs.

"Chinese Application Serial No. 201380055079.1, Office Action dated Oct. 31, 2016", W/ English Translation, 17 pgs.

Office Action as issued in Corresponding Chinese Patent Application No. 201380055079.1; dated Nov. 11, 2017.

Response to Office Action as issued in Corresponding Chinese Patent Application No. 201380055079.1; Response as filed Jan. 12, 2018.

Fourth Office Action dated Apr. 18, 2018 in corresponding Chinese patent application 201380055079.1(13 pages).

* cited by examiner

VENTILATION SYSTEM AND METHOD

BACKGROUND

Ventilating exhaust fans, such as those typically installed in bathrooms, draw air from within an area and pass the exhausted air out to another location, such as through a vent in the gable or roof of a home or other building structure. Centrifugal exhaust fans typically include a rotating fan wheel having a plurality of vanes that create an outward airflow which, in turn, is directed out of an outlet opening. The fan wheel is typically coupled to a motor supported within the fan housing, and the motor drives the fan wheel, thus providing ventilation to an area. In some cases, a curved fan scroll is employed to channel air around the fan, and can be defined by a housing wall of the fan or by a separate element or structure within the fan housing.

Many typical exhaust fans currently in use include a housing positioned within a building structure, such as in an aperture in a wall or ceiling. The housing can be secured in the aperture in a number of conventional manners, such as by being attached to wall or ceiling joists, or by being attached to other structure in the wall or ceiling.

In some cases, it may be desirable to replace an exhaust fan within a building or structure. For example, an old exhaust fan may need to be replaced when broken, or may generate unacceptable vibration or noise during operation. As another example, it may be desirable to replace an old exhaust fan with one that is more powerful, or has one or more features or characteristics different than the existing exhaust fan. However, conventional exhaust fans can be relatively difficult and time consuming to remove and replace. In most cases, replacement typically requires the assistance of a qualified electrician, the disconnection and re-connection of associated ductwork, and the removal and re-installation of the entire exhaust fan from the building structure.

SUMMARY

Some embodiments of the invention provide a ventilation exhaust fan comprising an upgrade cartridge assembly having a motor mounting plate coupled to at least one motor, at least one capacitor electrically coupled to the motor, a motor harness including at least one plug, and a blower wheel coupled with a scroll, coupled with the motor to generate a flow of fluid out of a fluid outlet.

In some embodiments, a duct connector assembly is provided. The duct connector assembly comprises a damper flap that is coupled with a ventilation orifice. The duct connector assembly is capable of being moved within the ventilation orifice to substantially control the backflow of a fluid into the ventilation orifice and the upgrade cartridge from a ventilation duct of a building. Furthermore, the duct connector assembly is further capable of substantially controlling the flow of fluid from a space into the ventilation of a duct of building when the motor is unpowered.

Some embodiments of the invention provide a ventilation exhaust fan comprising a main housing having a fluid inlet through which fluid is received within the main housing, and a fluid outlet through which fluid exits the main housing, wherein the housing is adapted to interchangeably receive an upgrade cartridge assembly having a motor, at least one capacitor electrically coupled to the motor, a motor harness including at least one plug, a motor mounting plate coupled to at least one motor and a blower wheel coupled within a scroll, coupled with the motor to generate a flow of fluid out of the fluid outlet.

In another aspect of the invention, a method of upgrading a ventilation exhaust fan is provided, and comprises a pre-existing main housing receiving an upgrade cartridge assembly having a motor mounting plate coupled to at least one motor, at least one capacitor electrically coupled to the motor, a motor harness including at least one plug, and a blower wheel coupled within a scroll, coupled with the motor to generate a flow of fluid out of the fluid outlet.

In another aspect of the invention, a method of changing a ventilation exhaust fan is provided, and comprising a main housing having a fluid inlet through which fluid is received within the main housing, and a fluid outlet through which fluid exits the main housing, wherein the housing is adapted to interchangeably receive an upgrade cartridge assembly having a motor mounting plate coupled to at least one motor, at least one capacitor electrically coupled to the motor, a motor harness including at least one plug, and a blower wheel coupled within a scroll, coupled with the motor to generate a flow of fluid out of the fluid outlet.

In another aspect of the invention, a method of replacing a ventilation exhaust fan is provided, and comprises a main housing having a fluid inlet through which fluid is received within the main housing, and a fluid outlet through which fluid exits the main housing, wherein the housing is adapted to interchangeably receive a upgrade cartridge assembly having a motor mounting plate coupled to at least one motor, at least one capacitor electrically coupled to the motor, a motor harness including at least one plug, and a blower wheel coupled within a scroll, coupled with the motor to generate a flow of fluid out of the fluid outlet. The ventilation exhaust fan is installed in a building or structure in place of an existing ventilation exhaust fan assembly.

In a further aspect of the invention, a method of assembling a ventilation apparatus is provided. The assembly method comprises assembling an upgrade cartridge assembly, including providing a motor plate, a motor, and a scroll that includes at least one locating rib, where the at least one locating rib is configured and arranged to center and guide the upgrade cartridge into a previously installed ventilation apparatus housing. The method also includes providing a blower wheel and mechanically coupling the blower wheel with the motor and the scroll, and securing the motor to the motor plate, providing a capacitor and electrically connecting the capacitor to the motor, and providing a motor harness including at least one plug capable of being coupled with at least one plug receptacle, and electrically coupling the at least one plug to the motor and the capacitor.

In another aspect of the invention, a method for ventilating a space is provided that includes providing the upgrade cartridge assembly including a motor and blower assembly, installing the upgrade cartridge assembly in a building or structure in place of an existing ventilation exhaust fan assembly, and providing electrical power to the upgrade cartridge assembly of a magnitude sufficient to drive the motor to turn the blower wheel.

In one further aspect of the invention, a method for ventilating a space is provided that includes providing a main housing having a fluid inlet through which fluid is received within the main housing, and a fluid outlet through which fluid exits the main housing, wherein the housing is adapted to interchangeably receive a fan upgrade cartridge assembly, and installing the main housing in a building or structure. The method further includes providing an upgrade cartridge assembly including a motor and blower assembly, installing the upgrade cartridge assembly in the main housing to form a ventilation exhaust fan assembly, and providing electrical power to the upgrade cartridge assembly of a magnitude sufficient to drive the motor to turn the blower wheel.

DESCRIPTION OF THE DRAWINGS

FIG. 6*b* is a side-rear close-up view of a fan cartridge scroll with grille spring holder according to one embodiment of the invention.

DETAILED DESCRIPTION

Figure 1:
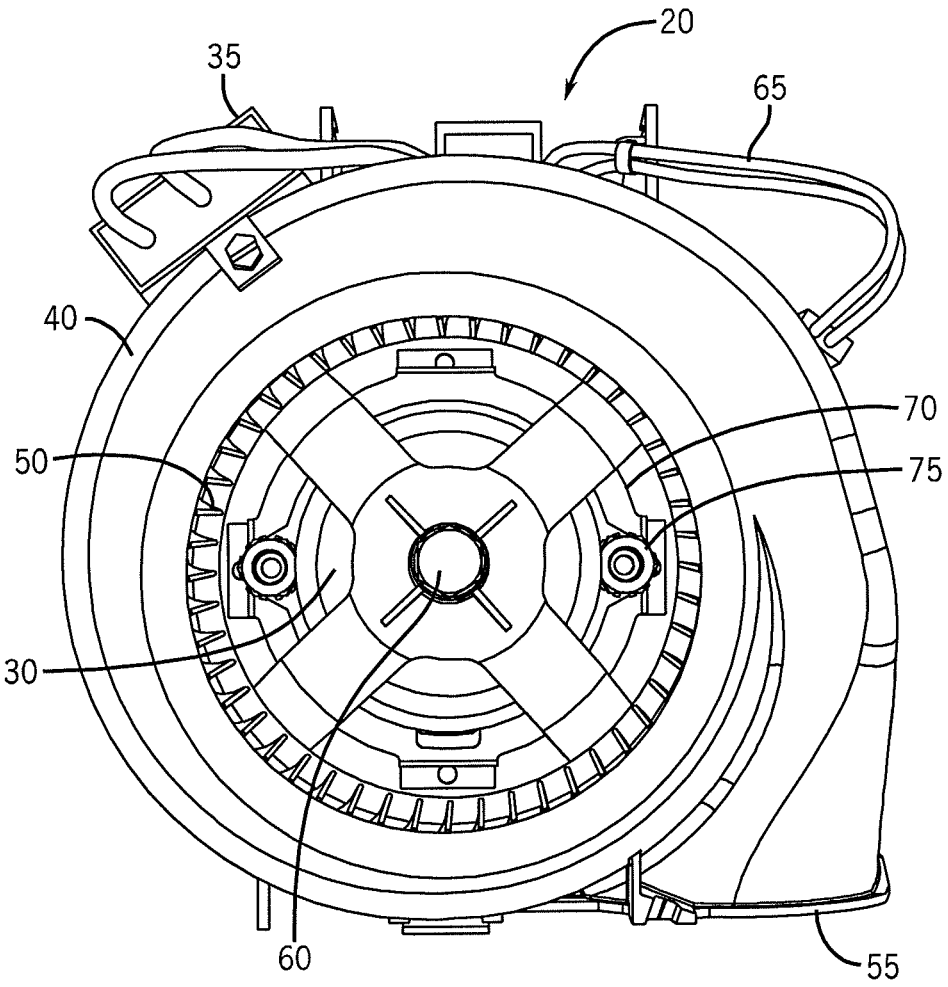
FIG. 1 is a top perspective view of a upgrade cartridge assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 7:
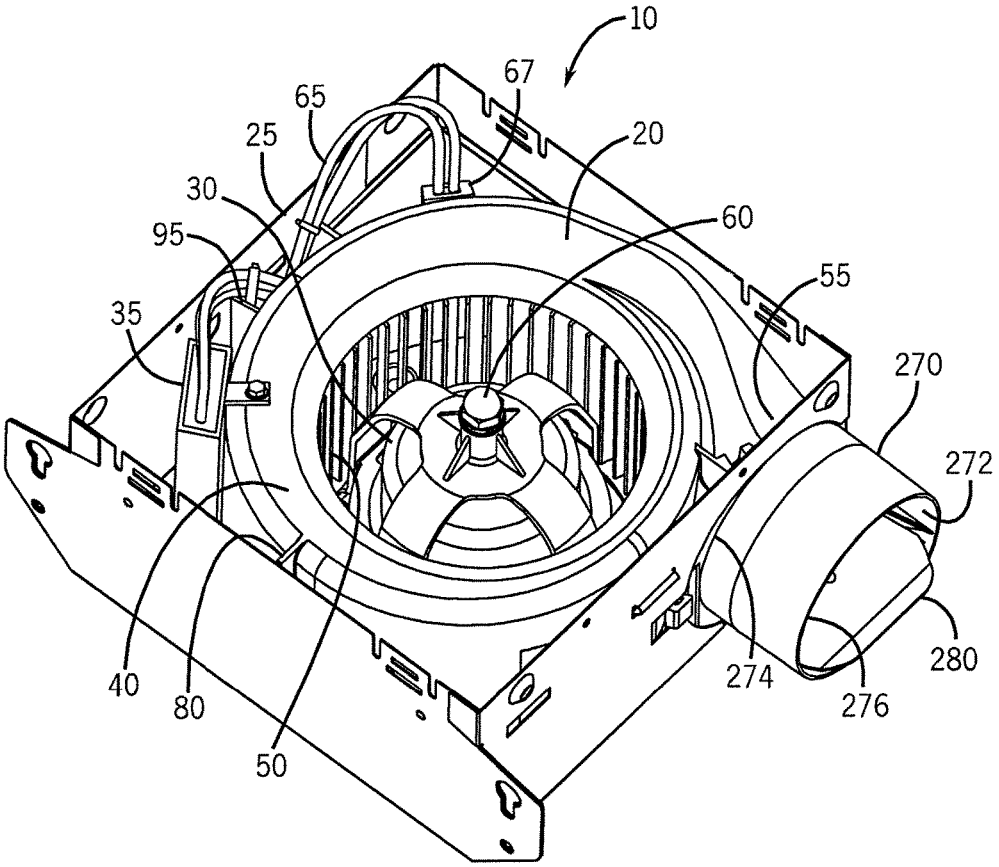
FIG. 7 is a top perspective view of a ventilation assembly according to one embodiment of the invention.
Figure 15:
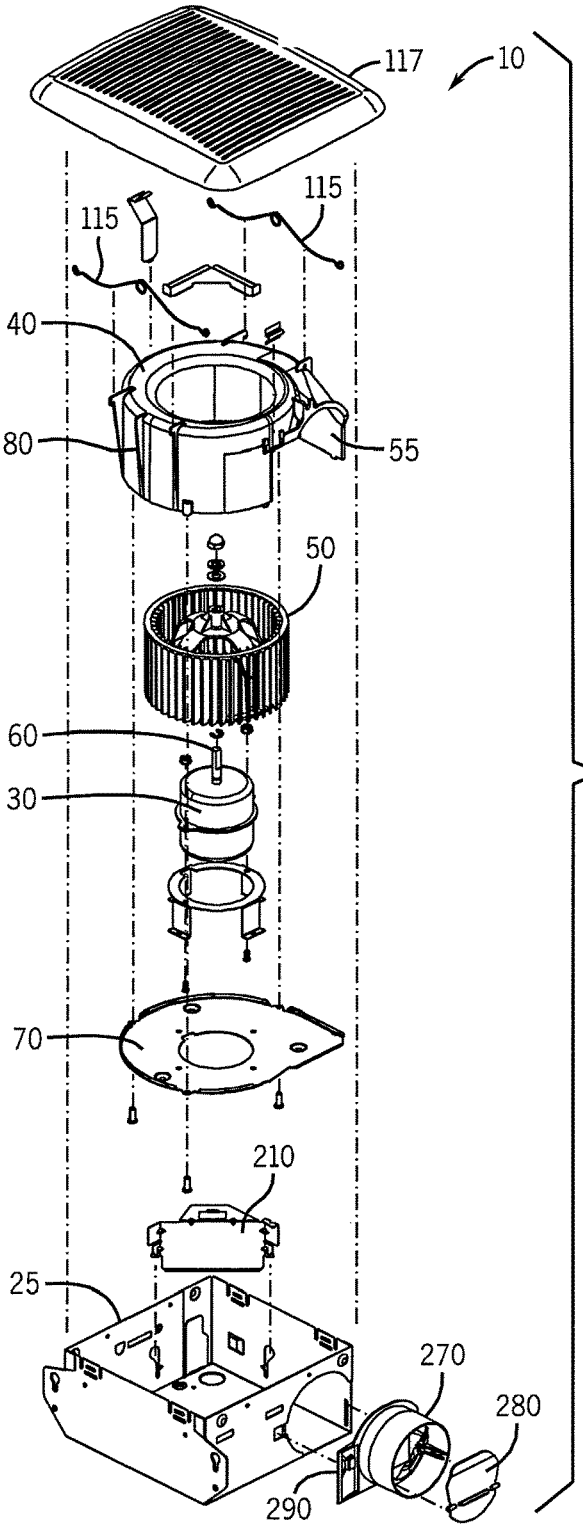
FIG. 15 shows an exploded view of a ventilation assembly according to one embodiment of the invention.

FIGS. 7 and 15 illustrate a ventilation assembly 10 according to one embodiment of the invention. Some embodiments of the ventilation assembly 10 can include several components and devices that can perform various functions. In some embodiments, the ventilation assembly can include a main housing 25, which can house the various components and devices of the ventilation assembly 10. In some embodiments the ventilation assembly 10 generally can include a upgrade cartridge assembly 20, substantially housed within the main housing 25, and positioned within the main housing 25 aided by a fan cartridge locating rib 80, and coupled to the main housing with a fan cartridge snap retention feature 85. In some embodiments the upgrade cartridge assembly 20 generally can include, a motor 30, such as a permanent split capacitor motor 30, and a motor capacitor 35. Some embodiments provide a upgrade cartridge assembly 20 that can also include a scroll 40 and a blower wheel 50 positioned substantially within the scroll 40 and mechanically coupled to the motor 30. Furthermore, in some embodiments, a duct connector assembly 270 can be coupled to the ventilation assembly 10. The duct connector assembly 270 can include a moveable damper flap 280 coupled with a ventilation orifice 272. In some embodiments the damper flap 280 can control the backflow of a fluid into a ventilation orifice 272 and the upgrade cartridge assembly 20, and further be capable of substantially controlling the flow of fluid from a space, such as a room, into the ventilation duct of a building, or structure, to an outside location.

In some embodiments, the ventilation assembly 10 can be used to ventilate any room, area or space. In some embodiments, the ventilation assembly 10 can be secured within a wall, ceiling, or other building structure in a partially, or fully recessed position. In some embodiments, the ventilation assembly 10 can be installed within an intermediate space, outside of the room, area or space, and coupled with one or more ventilation duct assemblies to provide ventilation to the room, area or space. In some other embodiments, the fluid may comprise air, or other gases, or vapor, such as water vapor. In some embodiments, the fluid may comprise a smoke, ash, or other particulate in addition to air or other gases.

In some embodiments, the ventilation assembly 10 can be installed as a new, original equipment installation in a room or building where none had previously existed, whereas some embodiments of the invention provide a ventilation assembly 10 that can replace a pre-existing ventilation system. In some embodiments, the upgrade cartridge assembly 20, can be installed as a new, or a replacement ventilation system, and in some embodiments, the upgrade cartridge assembly 20 can replace an existing upgrade cartridge assembly 20.

As shown in the top perspective view of FIG. 1, in some embodiments of the invention, an upgrade cartridge assembly 20 can be provided as a compact assembly comprising a permanent split capacitor motor 30, motor mounting plate 70, nestled within a scroll 40, and coupled to a blower wheel 50. In some embodiments, the motor 30 can be mechanically secured to the motor mounting plate 70 using at least one motor plate bolt 75, and can be any motor capable of providing sufficient rotational torque to turn the blower wheel 50. In some embodiments the blower wheel 50 can be mechanically coupled to the motor using a main drive bolt, (see first end 60 of the main drive bolt in FIG. 1). In some embodiments, when a permanent split capacitor motor 30 is used, the motor 30 can be electrically coupled to at least one permanent split capacitor 35. As shown in FIG. 1, the permanent split capacitor 35 may be secured to the scroll 40, or in some other embodiments, it may be secured to another component of the ventilation assembly 10. In some embodiments, the motor 30 is electrically coupled to a motor power harness 65 that is electrically coupled to the capacitor 35. In some other embodiments, the permanent split capacitor 35 may be secured to a surface of a structure of a building, adjacent to the upgrade cartridge assembly 20, and electrically coupled with the upgrade cartridge assembly 20 with a motor power harness 65 (not shown).

Figure 2:
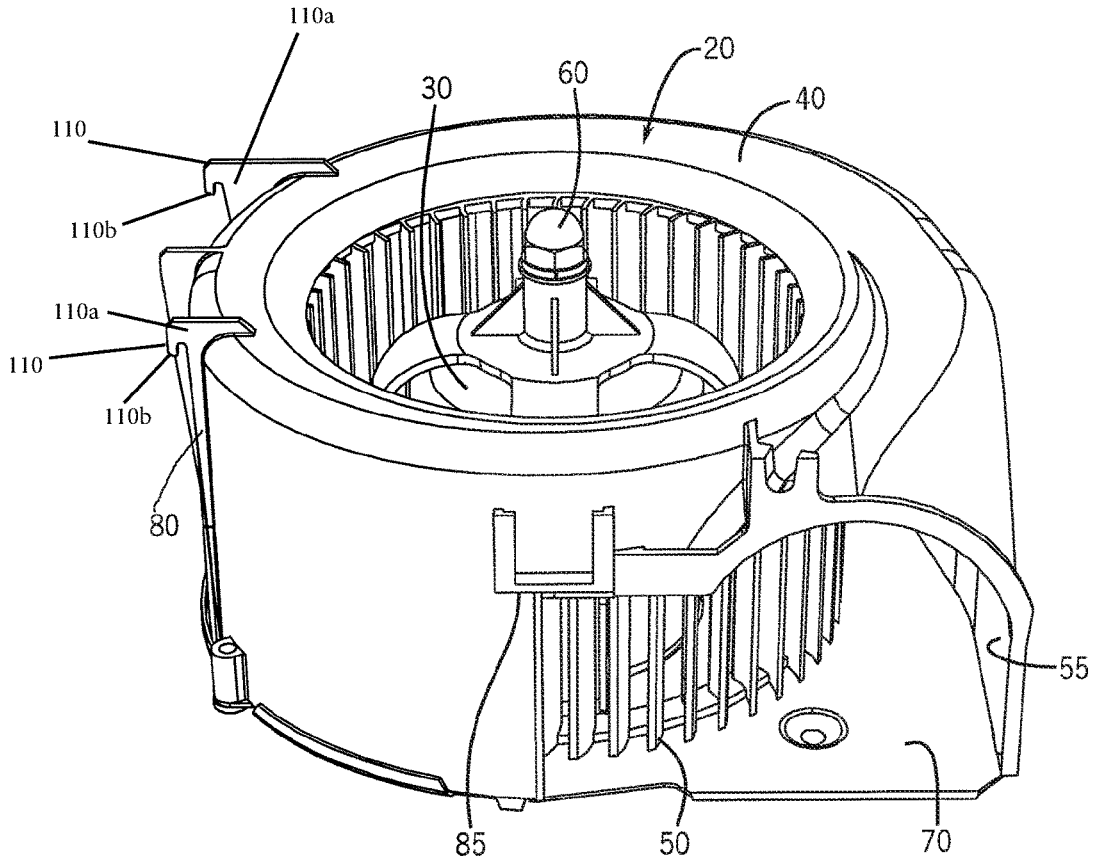
FIG. 2 is a side perspective view of a upgrade cartridge assembly according to one embodiment of the invention.
Figure 5:
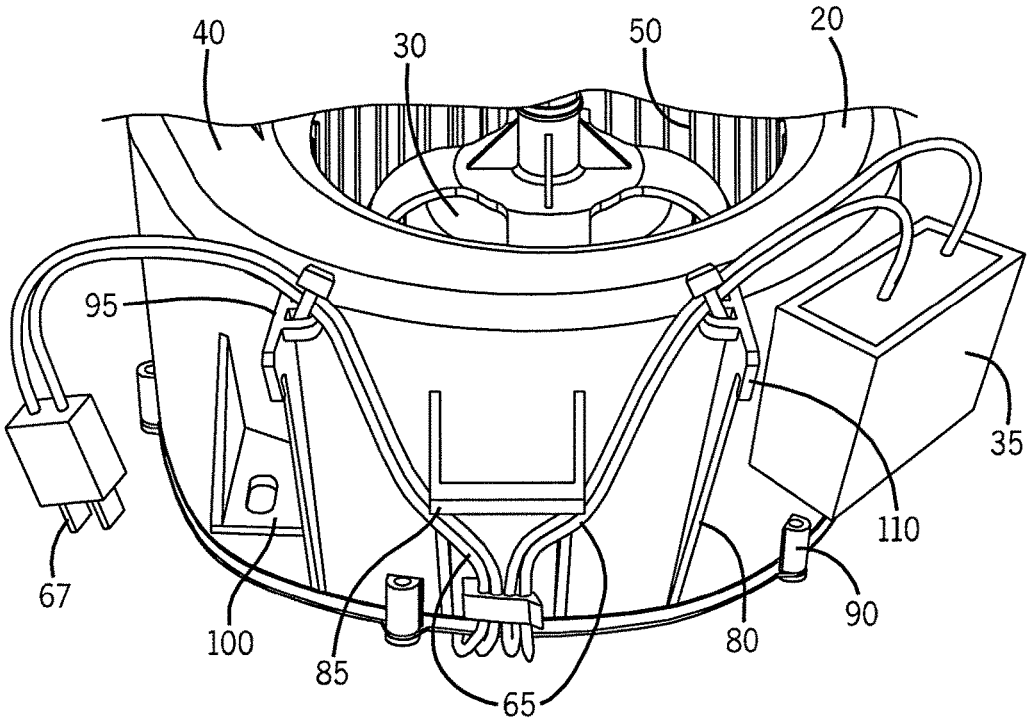
FIG. 5 is a rear perspective view of a upgrade cartridge assembly according to one embodiment of the invention.

As shown in the side perspective view of a upgrade cartridge assembly 20 of some embodiments of the invention in FIG. 2, the scroll can be formed into any shape, but generally is shaped to provide a compact and optimal fluid flow towards the blower outlet 55 when coupled to the motor mounting plate 70. For example, in the embodiment depicted in FIG. 2, the scroll 40 comprises an outermost peripheral wall 44 extending substantially around the perimeter of the blower wheel 50 and an intake wall 46 extending inward from the peripheral wall 44 over the top of the blower wheel 50 to an intake periphery 48 defining an intake aperture through which air enters the scroll 40. The scroll may be formed from any material that is readily shaped, including, but not limited to, polymers, polymer-composites, metal, ceramic, or wood, or paper-based composite or laminate. Furthermore, the use of injection-molded or thermo-formed polymeric materials conveniently allows a variety of functional components to be included into the structure of the scroll 40. For example, in some embodiments, as shown in FIG. 2, the upgrade cartridge assembly 20 can include at least one fan cartridge locating rib 80. In the embodiment depicted in FIG. 2, the locator rib 80 extends outward from the scroll outermost peripheral wall 44. The rib 80 provides centering and guidance when maneuvering the upgrade cartridge assembly 20 within a main housing 25 to form the ventilation assembly 10. In some further embodiments, other useful features can be provided. For example, as shown in FIG. 2, in some embodiments the scroll 40 can include a fan cartridge snap retention feature 85. The cartridge snap retention feature 85 is also shown in more detail in FIG. 5, showing the positional relationship with respect to the capacitor 35 and the motor power harness 65. In some embodiments, the cartridge snap retention feature 85 may be integral with the scroll 40, and can be used to secure the upgrade cartridge assembly 20 into a main housing 25 of a ventilation assembly 10. In some other embodiments, the cartridge snap retention feature 85 is not integral to the scroll, but a separate component (not shown). In some embodiments, the cartridge snap retention feature 85 can be integral with the scroll 40, however the upgrade cartridge assembly 20 may be coupled with the main housing 25 using alternative methods.

Figure 3:
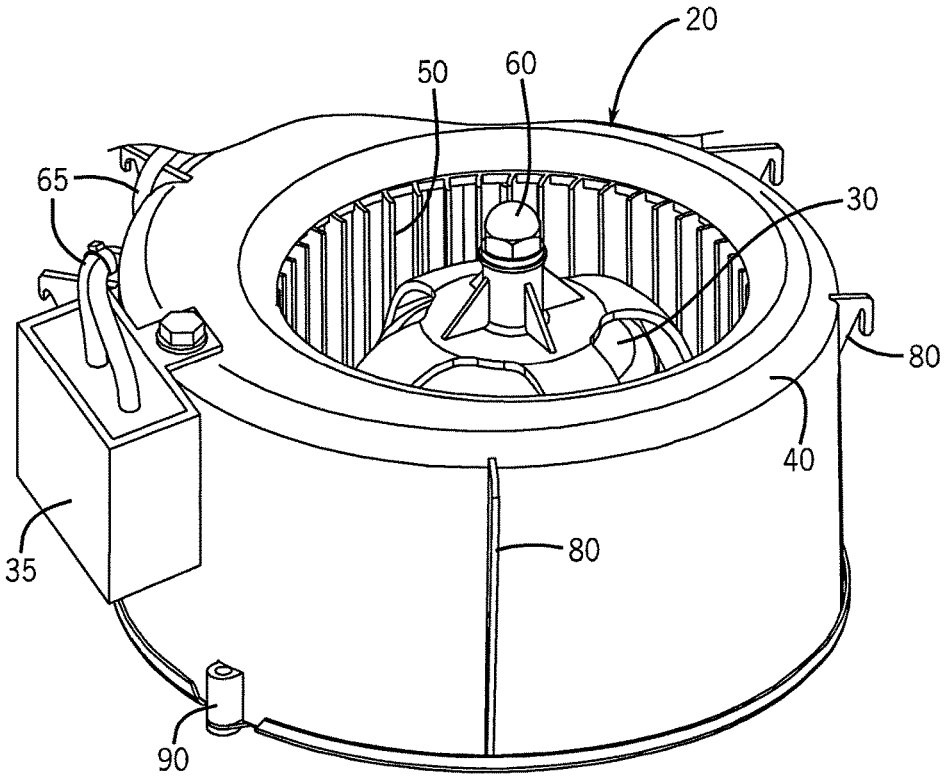
FIG. 3 is a side perspective view of a upgrade cartridge assembly according to one embodiment of the invention.

In some embodiments, other useful features may be integral with the scroll 40. For example, as shown in FIG. 3, a screw boss 90 may be formed. In some other embodiments, more than one screw boss 90 may be formed. The screw boss 90 provides an anchoring feature for a fastener (not shown) to secure the scroll 40 to the motor mounting plate. In some embodiments, a surface of the scroll 40 may provide an anchoring point for other components of the upgrade cartridge assembly 20. For example, one or more screw holes (not shown) may provide an anchoring location for the motor capacitor 35, while at least one side of the scroll may provide a mating surface for other components. As shown in FIG. 3, other surfaces of the scroll 40 may provide a convenient location for further fan cartridge locating ribs 80.

Figure 4:
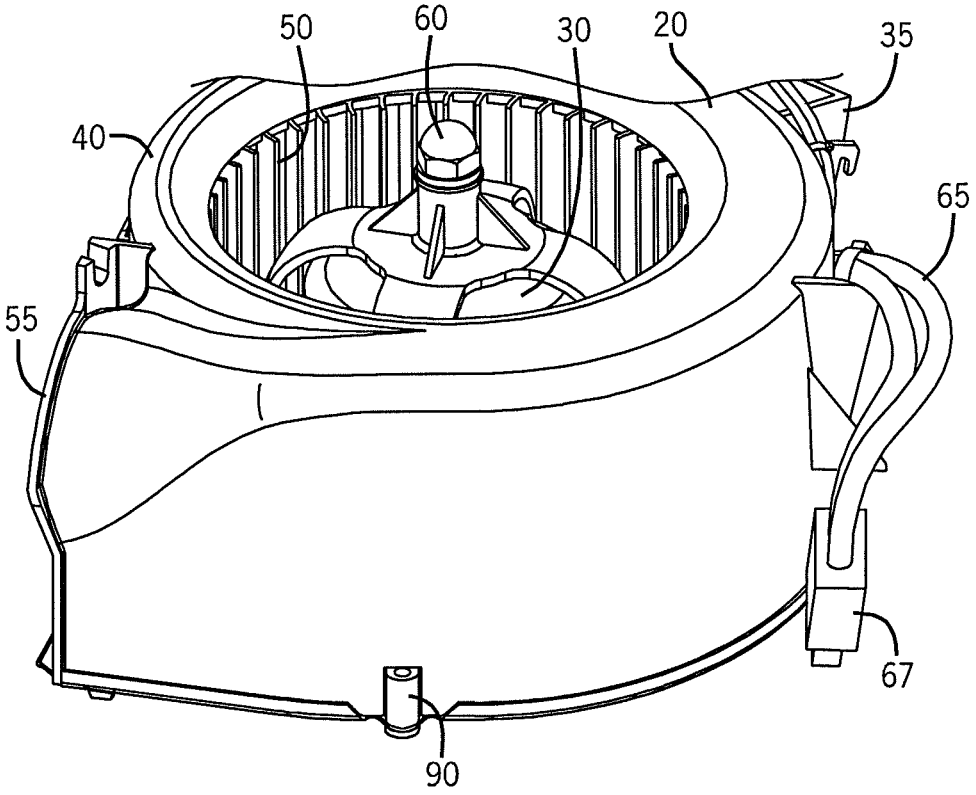
FIG. 4 is a side perspective view of a upgrade cartridge assembly according to one embodiment of the invention.

In some embodiments, one or more integral features of the scroll may provide an anchoring location for at least one component of the motor power harness 65. For example, referring to FIG. 4, showing a side perspective view of a upgrade cartridge assembly 20 according to one embodiment of the invention, the motor power harness 65 may be secured with at least one feature integral to the scroll. Also shown in FIG. 4, in some embodiments, the motor power harness, secured to the scroll 40 can include at least one plug 67. Referring again to FIG. 5, in some embodiments, the one or more wires of the motor power harness 65 can be secured to the scroll using a component integral to the scroll 40. In some embodiments, as shown in FIG. 5, holes may be integral to the scroll to provide a guide for at least one wire of the motor power harness 65. In some embodiments, plastic tie-wrap may be used (as shown in FIG. 5), in addition to other methods, however in other embodiments, other methods may be used, such as clips, wire, wrap, or adhesive, or the like.

In other embodiments of the invention, other useful features can be integral to the scroll 40. For example, the rear perspective view of a upgrade cartridge assembly 20 in FIG. 5 shows an anchor 100, formed within the body of the scroll. In some embodiments, the scroll 40 can include at least one anchor 100. In some embodiments, the anchor 100 can be used with a fastener (not shown), to anchor the upgrade cartridge assembly to the main housing 25. As described above, in some embodiments the scroll 40 can include a fan cartridge snap retention feature 85 (also shown in FIG. 5). In some embodiments, the cartridge snap retention feature 85 can be used to secure the upgrade cartridge assembly 20 into a main housing 25 of a ventilation assembly 10. In some other embodiments, the cartridge snap retention feature 85 is not integral to the scroll, but a separate component (not shown). In some embodiments, the cartridge snap retention feature 85 can be integral with the scroll 40, however the upgrade cartridge assembly 20 may be coupled with the main housing 25 using alternative methods, for example, using at least one anchor 100. In some embodiments, the upgrade cartridge assembly 20 can be secured into the main housing 25 of a ventilation assembly 10 using at least one anchor 100, and at least one fan cartridge snap retention feature 85.

Figure 6A:
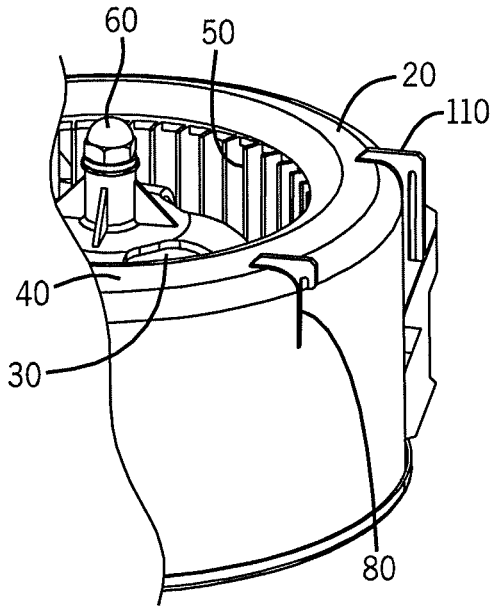
FIG. 6*a* is a side-rear view of a upgrade cartridge assembly scroll with grille spring holder according to one embodiment of the invention.
Figure 6B:
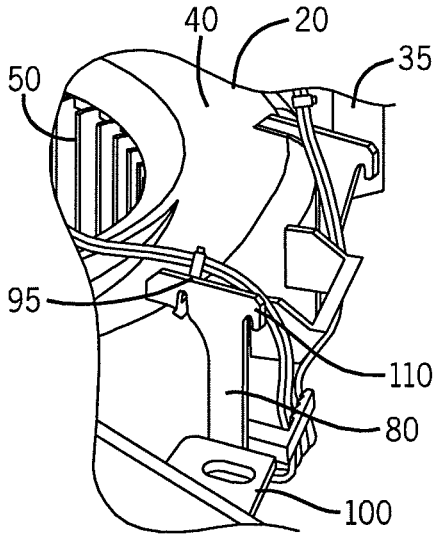
FIG. 6*b* is a side-rear close-up view of a upgrade cartridge assembly scroll with grille spring holder according to one embodiment of the invention.

In some further embodiments of the invention, other useful features can be formed integral to the scroll 40. For example, as shown in the side-rear view of a upgrade cartridge assembly 20 in FIG. 6*a* and FIG. 6*b*, the scroll features a grille spring holder 110 according to one embodiment of the invention. The embodiment depicted in FIG. 2 comprises two grille spring holders 110, each extending outward from the scroll 40 and open downward defining a downwardly open hook. The fan cartridge snap retention feature 85 is situated between the two grille spring holders 110. More specifically, FIG. 2 depicts an extension leg 110*a* extending outward from each rib 80 and a downward depending leg 110*b* extending downward (opposite to direction of airflow being drawn into the intake aperture of the scroll 40) from each extension leg 110*a* and spaced from the adjacent rib 80 to define a downwardly open hook. Referring to the exploded projection view in FIG. 15, in some embodiments, the grille spring holder 110 can be used with a spring 115 to conveniently secure a grille 117 to the ventilation assembly 10.

Figure 8:
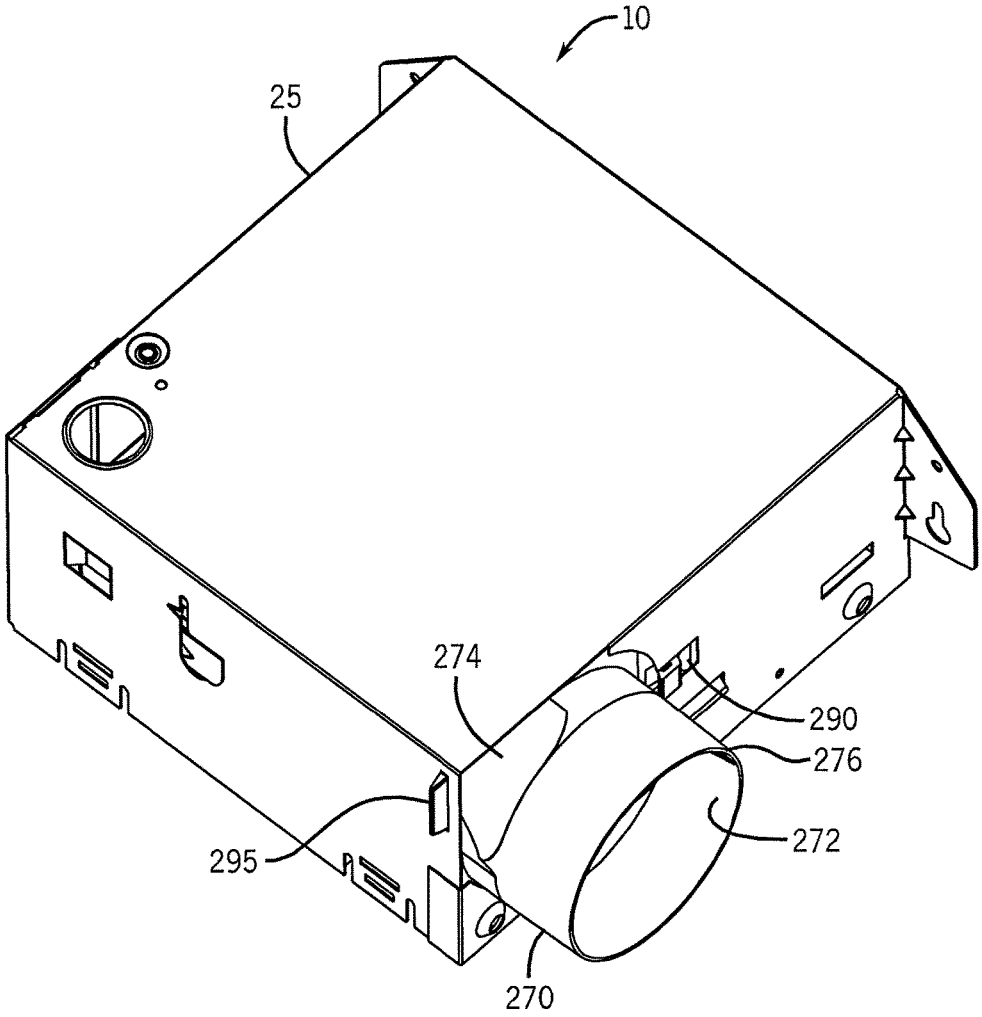
FIG. 8 is a bottom perspective view of a ventilation assembly according to one embodiment of the invention.

FIG. 7 is a top perspective view of a ventilation assembly 10 according to one embodiment of the invention. As discussed earlier, one or more of the embodiments of the upgrade cartridge assembly 20 as shown in FIG. 1-5 may be coupled with a main housing 25 to form a ventilation assembly 10. For example, in FIG. 7, the ventilation assembly 10 is shown in perspective without the aforementioned grille 117, (shown in FIG. 15). A bottom perspective view is shown in FIG. 8, showing the bottom side of the main housing 25. In some embodiments, the main housing 25 may be formed into any shape, included but limited to, a rectangular box-like shape, an oval shape, a hemispherical shape, a spherical shape, a pyramidal shape, or any other shape. In some embodiments the main housing is formed from a sheet metal, including, but not limited to an aluminum-based metal, a steel or iron-based metal, a zinc-based metal, or a nickel and tin-based metal. In some other embodiments, the main housing 25 may be formed from injection molded polymers, thermo-formed polymers, thermosetting polymers, or sheet metal, or any other suitable material. In some other embodiments, the housing may comprises a wood-based product, such as wood, or particleboard or wood laminate. In some embodiments, the main housing 25 can form a base or a similar support structure of the ventilation assembly 10. Furthermore, in some embodiments, the main housing 25 can provide points and areas of attachment for the upgrade cartridge assembly 20, or other components of the assembly 10.

In some embodiments, the ventilation assembly 10 can include a duct connector assembly 270, comprising a first end 274 coupled with the main housing 25, and the blower outlet 55 (not shown), and a second end 276, forming a ventilation orifice 272. In some embodiments, the duct connector assembly 270 is pre-installed in a building structure and the duct connector assembly is coupled with a ventilation duct of a building with the second end 276 of the duct connector assembly 270. In some embodiments, the main housing 25 is firstly installed in an existing cavity or aperture of a structure such as a wall or ceiling. Subsequently the duct connector assembly 270 is installed by connecting a second end 276 with a ventilation duct of a building, and a first end 274 with an aperture in the main housing 25 (not shown). Installation is completed by securing a upgrade cartridge assembly 20 substantially in the main housing, positioning the blower outlet 55 adjacent to the first end 274 of the duct connector assembly 270 installed adjacent to an aperture of the main housing 25.

Moreover, as shown in FIG. 7, illustrating a top perspective view of a ventilation assembly 10 according to one embodiment of the invention, the duct connector assembly can comprise a damper flap 280. In some embodiments, the ventilation assembly 10 can be operable to discharge fluid flow from a space to another location. For example, in some embodiments, when power is provided to the upgrade cartridge assembly 20, a motor 30, such as a permanent split capacitor motor 30, can rotate a blower wheel 50 positioned substantially within a scroll 40. Fluid flow is moved substantially towards the duct assembly, and the moveable damper flap 280 coupled with a ventilation orifice 272 will open, allowing fluid to be expelled from the ventilation assembly 10. In some embodiments the damper flap 280 can control the backflow of a fluid into the ventilation orifice 272 and the upgrade cartridge assembly 20, and further be capable of substantially controlling the flow of fluid from a space, such as a room, into the ventilation duct of a building, or structure, to an outside location.

Figure 9:
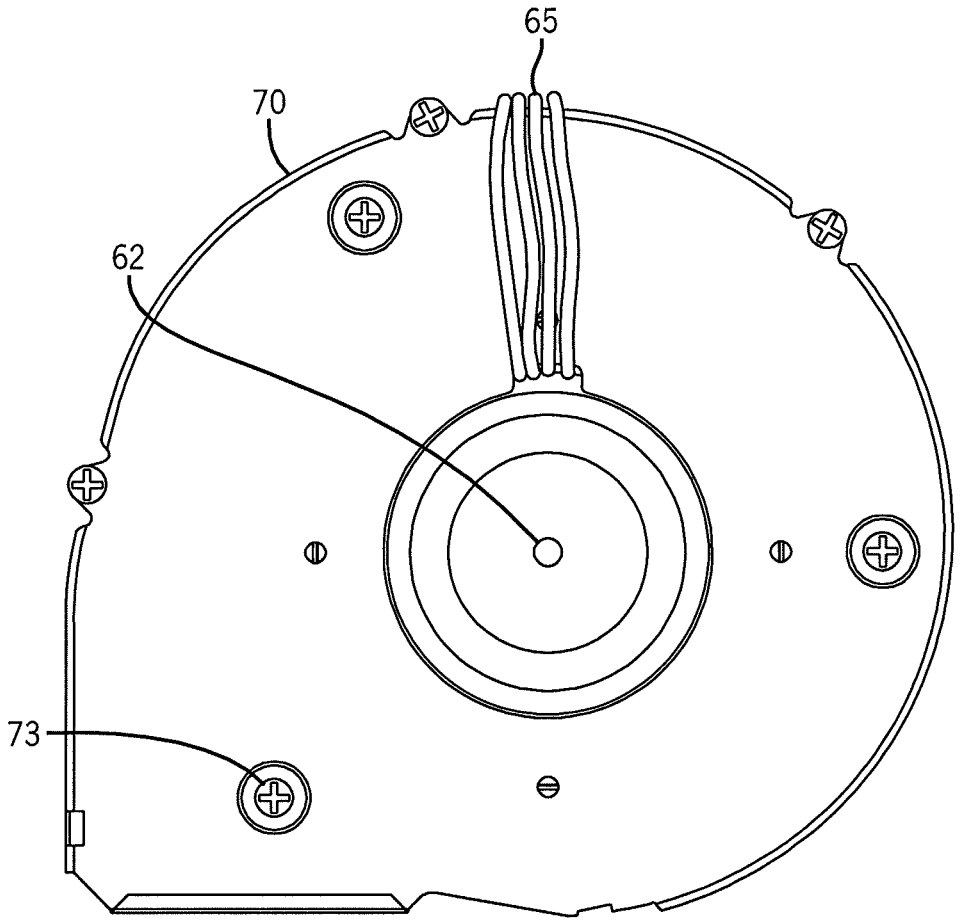
FIG. 9 is a bottom perspective view of a upgrade cartridge assembly according to one embodiment of the invention.

As discussed previously, some embodiments of the invention comprise a cartridge upgrade assembly that includes a motor mounting plate. For example, as shown in FIG. 9, a bottom perspective view of a upgrade cartridge assembly 20 shows a motor mounting plate 70 with the fan cartridge upgrade assembly 20 components mounted to the motor mounting plate 70. In some embodiments, the scroll 40 includes at least one screw boss 90 which provides an anchoring feature for a fastener 73 to secure the scroll 40 to the motor mounting plate 70. As shown in FIG. 9, a permanent split capacitor motor 30 is mounted on the opposite side of the motor mounting plate 70, and the second end 62 of the main drive bolt can be seen at the base of the motor 30.

Figure 10A:
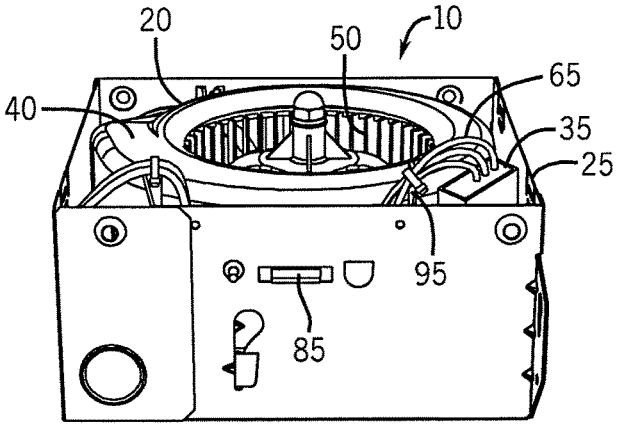
FIG. 10*a* is a side perspective view of a ventilation assembly according to one embodiment of the invention.
Figure 10B:
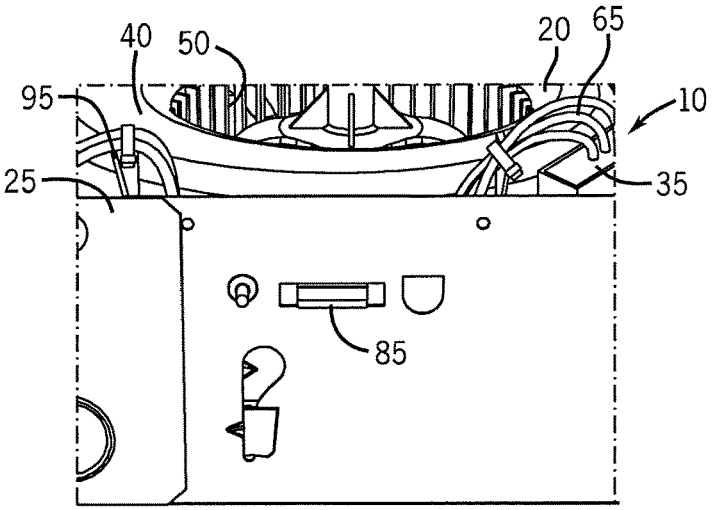
FIG. 10*b* is a close-up view of a side of a ventilation assembly according to one embodiment of the invention.
Figure 10C:
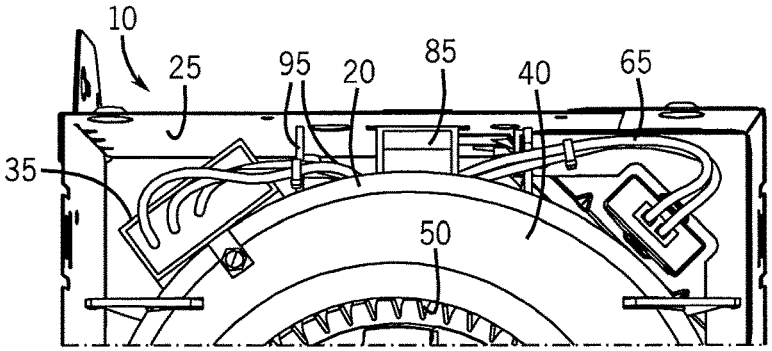
FIG. 10*c* is a close-up top view of the ventilation assembly according to one embodiment of the invention.
Figure 11:
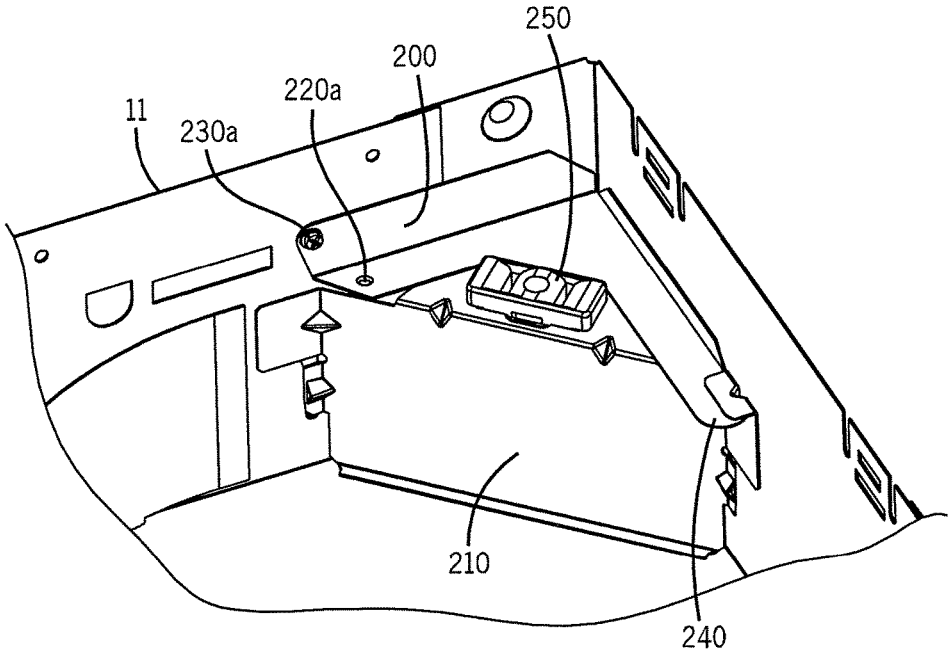
FIG. 11 is a close-up view of the electrical box enclosure of a main housing according to one embodiment of the invention.

As described previously, it may be desirable to replace an exhaust fan within a building or structure. For example, an old exhaust fan may need to be replaced when broken, if the fan produces excessive vibration or noise during operation. It may be desirable to replace an old exhaust fan with one that is more powerful, or has one or more features or characteristics different than the existing exhaust fan. However, conventional exhaust fans can be relatively difficult and time consuming to remove and replace. By providing a ventilation assembly 10 that comprises a upgrade cartridge assembly 20 with certain attachment and detachment features, replacement or upgrade can be a faster and less complex task. For example, as discussed earlier, some embodiments of the invention include a scroll 40 with a fan cartridge snap retention feature 85 (see FIG. 2 and FIG. 5). In some embodiments of the invention, a upgrade cartridge assembly 20 is secured into a main housing 25 using at least one fan cartridge snap retention feature 85. For example referring to FIG. 10 showing a side perspective view of a ventilation assembly 10 according to one embodiment of the invention, the fan cartridge snap retention feature 85 can be seen engaged into an aperture in the main housing 25. In some embodiments of the invention, one or more fan cartridge snap retention feature 85 can retain the upgrade cartridge assembly 20 in a main housing 25 without the use of additional tools or hardware. As discussed previously, the fan cartridge snap retention feature 85 can be an integral part of the scroll 40, or may be a separate component. FIG. 10*b* shows a close-up view of a side of a ventilation assembly 10 according to one embodiment of the invention, and the fan cartridge snap retention feature 85 can be seen exiting the main housing 25. FIG. 10*c* is a close-up top view of the ventilation assembly 10 according to one embodiment of the invention showing a fan cartridge snap retention feature 85 as an integral part of the scroll 40, engaged with the main housing 25.

Figure 12:
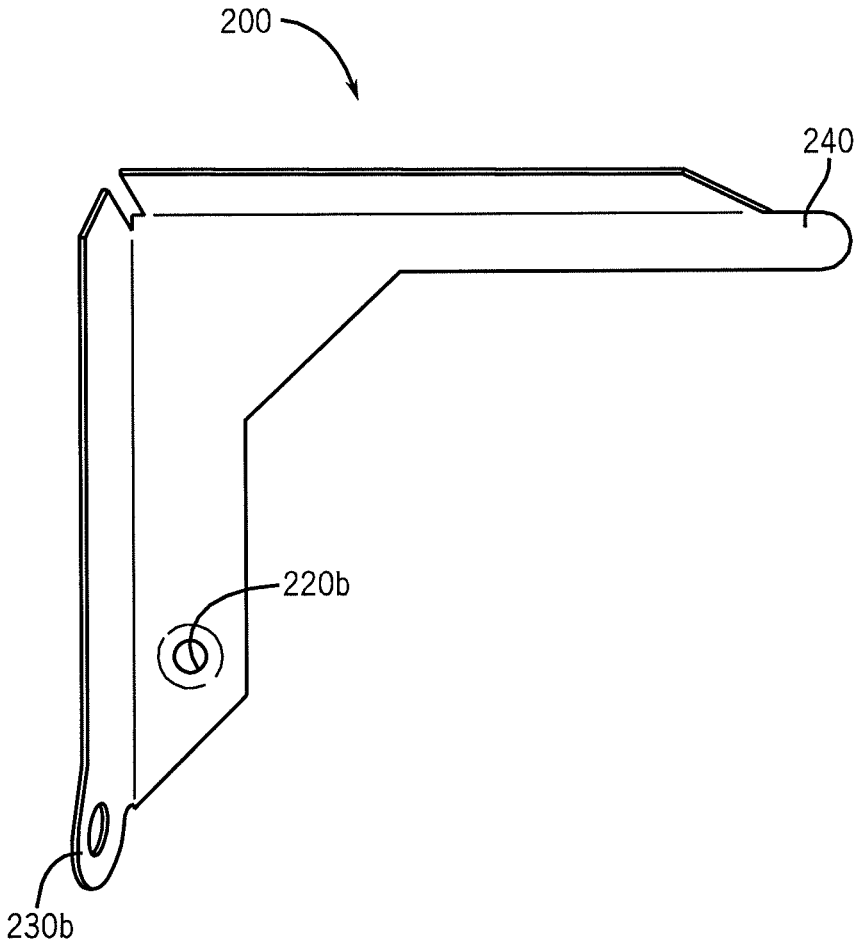
FIG. 12 is a close-up view of the electrical box cover plate according to one embodiment of the invention.

Some embodiments of the invention provide a ventilation exhaust fan comprising a upgrade cartridge assembly 20 having at least one permanent split capacitor motor, at least one permanent split capacitor electrically coupled to the motor, a motor harness including at least one plug, and a blower wheel coupled with a scroll, coupled with the motor to generate a flow of fluid out of the fluid outlet. In some embodiments, the motor 30 is electrically coupled to a motor power harness 65 that is electrically coupled to the capacitor 35. In some embodiments, the upgrade cartridge assembly 20 can be installed within an intermediate space, outside of the room, area or space, and coupled with one or more ventilation duct assemblies to provide ventilation to the room, area or space. In some embodiments, the upgrade cartridge assembly 20, can be installed as a new, or a replacement ventilation system, and in some embodiments, the upgrade cartridge assembly 20 can replace an existing upgrade cartridge assembly 20. Furthermore, in some embodiments, the main housing 25 can provide points and areas of attachment for the upgrade cartridge assembly, or other components of the assembly 10. In some embodiments, when the main housing 25 is installed, an electrical box enclosure 210 is positioned within the main housing to provide a source of electrical power to the capacitor 35 and motor 30. In some embodiments, the electrical box enclosure 210 comprises an electrical box cover plate 200, an electrical box anchoring tab 240 to secure the electrical box cover plate 200 to the electrical box enclosure 210. The electrical box cover plate 200 can be seen in more detail in FIG. 12. As show, in some embodiments, electrical box attachment screw holes 230*a* and 230*b* are included and used with a fastener (not shown) to secure the electrical box cover plate 200 to the main housing 25. Furthermore, electrical box anchors 220*a* and 220*b* can be used to anchor the electrical box enclosure 210 to the main housing 25. In some embodiments the electrical box enclosure 210 includes a power receptacle 250.

In some embodiments, when the main housing 25 is installed, an electrical box enclosure 210 is positioned within the main housing and the internal wiring of the main housing (not shown) is coupled with a electrical power supply to supply electrical power to the power receptacle 250. As described earlier, in some embodiments of the invention, an upgrade cartridge assembly 20 can include a motor power harness 65 that may be secured, with at least one feature integral to the scroll. Also shown in FIG. 4, in some embodiments, the motor power harness, secured to the scroll 40 can include at least one plug 67.

In some embodiments of the invention, the main housing can be pre-installed by inserting into a cavity or aperture of a structure. In some embodiments, following assembly and installation of at least the main housing 25, the installer can connect one or more terminals of the power receptacle 250 to an external source of electrical power. The electrical box enclosure 210 and the electrical box cover plate 200 can be fully assembled, and the power receptacle 250 can be coupled to the external power source. The installer can maneuver the upgrade cartridge assembly 20 in the main housing 25 and the plug 67 can be coupled with the power receptacle 250. In some embodiments, the plug 67 can be coupled with the power receptacle 250, and then the installer can maneuver the upgrade cartridge assembly 20 in the main housing 25. In some embodiments, once the upgrade cartridge assembly 20 has been maneuvered into the main housing 25, one or more cartridge snap retention features 85 can be used to secure the upgrade cartridge assembly 20 into a main housing 25 of a ventilation assembly 10. In some other embodiments, the ventilation assembly 10 may be fully assembled and installed directly into a cavity or aperture of a structure.

Figure 13A:
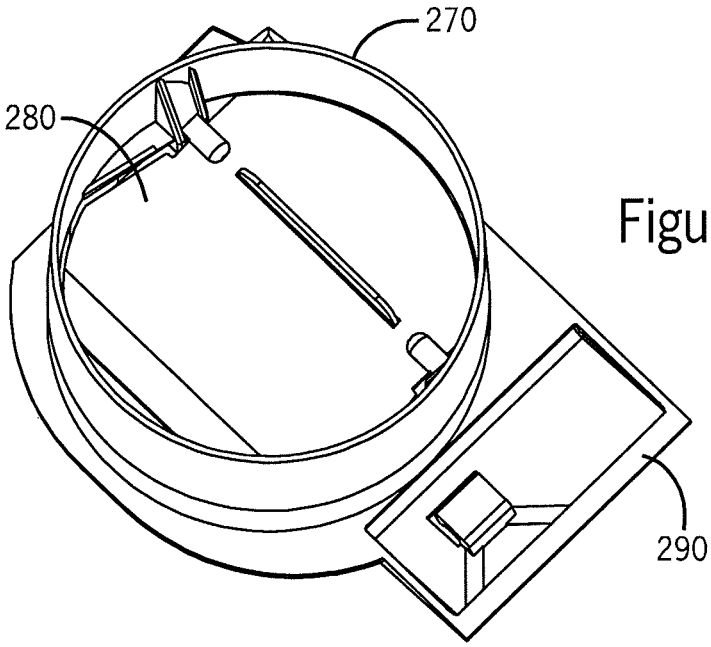
FIG. 13*a* is a close-up view of a duct connector assembly with a closed damper flap according to one embodiment of the invention.
Figure 13B:
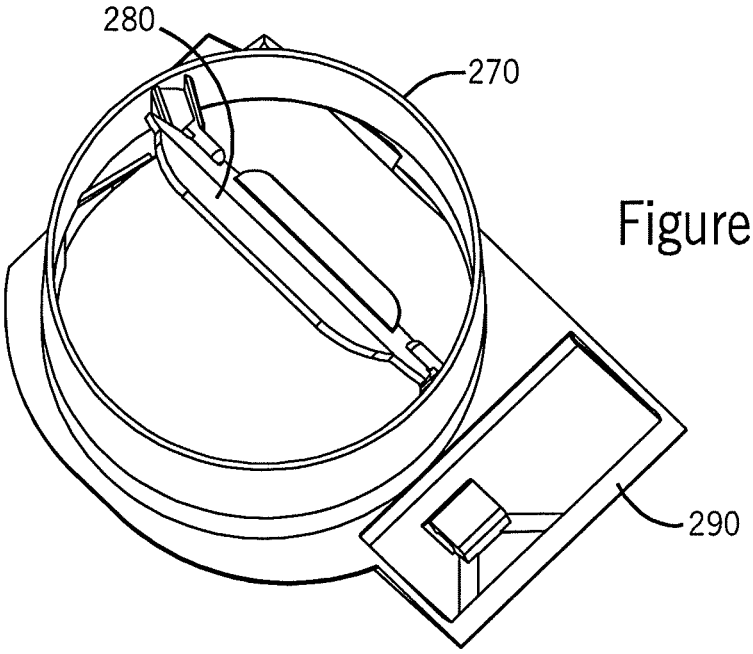
FIG. 13*b* is a close-up view of a duct connector assembly with an open damper flap according to one embodiment of the invention.
Figure 14A:
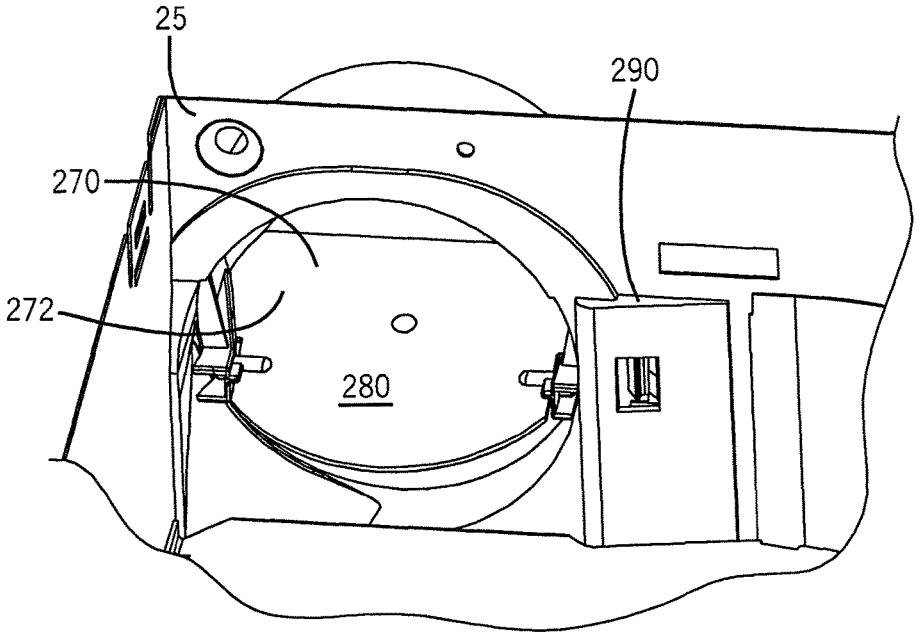
FIG. 14*a* is a close-up view of a duct connector assembly installed in a main housing viewed from within the main housing according to one embodiment of the invention.
Figure 14B:
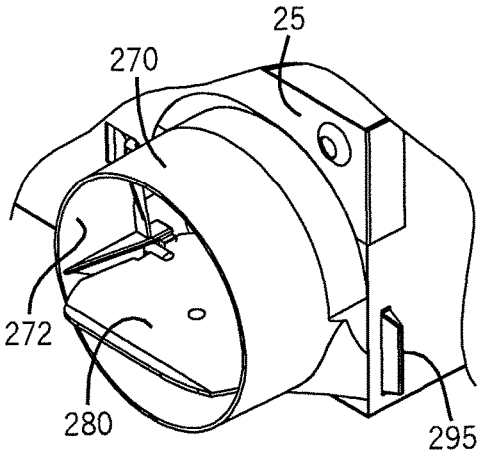
FIG. 14*b* is a close-up view of a duct connector assembly installed in a main housing according to one embodiment of the invention.
Figure 14C:
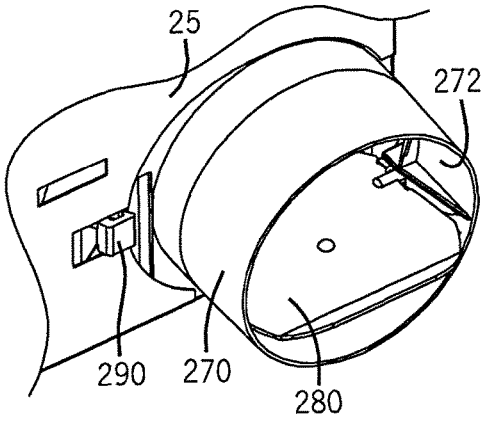
FIG. 14*c* is a close-up view of a duct connector assembly installed in a main housing according to one embodiment of the invention.

As discussed earlier, in some embodiments of the invention, the ventilation assembly 10 can include a duct connector assembly 270, comprising a first end 274 coupled with the main housing 25, and the blower outlet 55, and a second end 276, forming a ventilation orifice 272. In some embodiments, the main housing 25 is firstly installed in an existing cavity or aperture of a structure such as a wall or ceiling. Subsequently, the duct connector assembly 270 is installed by connecting a second end 276 with a ventilation duct of a building, and a first end 274 with an aperture in the main housing 25 (not shown). Installation is completed by securing a upgrade cartridge assembly 20 substantially in the main housing, positioning the blower outlet 55 adjacent to the first end 274 of the duct connector assembly 270 installed adjacent to an aperture of the main housing 25. In some embodiments, the duct connector assembly 270 is pre-installed in a building structure and not pre-installed in the main housing 25 of a ventilation assembly 10. As shown in FIG. 13*a* and FIG. 13*b*, in some embodiments, the duct connector assembly 270 can comprise damper flap 280 that is rotatable within the duct connector assembly 270, and in some embodiments, can further include a duct snap mounting assembly 290. In some embodiments, the ventilation assembly 10 may be fully assembled and include a duct connector assembly 270 including a duct snap mounting assembly 290. As shown in FIG. 14*a*, one embodiment showing a close-up view of a duct connector 270 assembly installed in a main housing 25 viewed from within the main housing 25, with the duct snap mounting assembly 290 forcibly securing the duct connector assembly 270 to the main housing 25. FIG. 14*b* and FIG. 14*c* show the outside view of the fully assembled ventilation assembly 10. FIG. 14*b* is a close-up view of a duct connector assembly installed in a main housing according to one embodiment of the invention, and shows a duct connector tab 295 coupled with the main housing 25 when the duct connector assembly 270 is fully installed in the main housing 25. FIG. 14*c* is a close-up view of a duct connector assembly installed in a main housing according to one embodiment of the invention showing a portion of the duct snap mounting assembly 290 extending outside of an aperture in the main housing 25 as the assembly 290 forcibly secures the duct connector assembly 270 to the main housing 25.

FIG. 15 shows an exploded view of a ventilation assembly 10 according to one embodiment of the invention. Referring to the exploded projection view showing the grille spring holder 110, (shown previously for example in the side-rear view of a upgrade cartridge assembly 20 in FIG. 6*a* and FIG. 6*b*), once the ventilation assembly installation has been completed, a spring 115 can be used to conveniently secure a grille 117 to the ventilation assembly 10. In some other embodiments, the grille 117 may be secured to the ventilation assembly 10 with more than one spring 115 and more than one grille spring holder 110. In some other embodiments, the grille 117 may be secured to the ventilation assembly 10 by some other component, such as a clip, a wire, a wrap, or adhesive, or the like. In some embodiments, the grille 117 can be formed from injection molded polymers, thermo-formed polymers, thermosetting polymers, or sheet metal, or any other suitable material.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A ventilation apparatus, comprising:

an upgrade cartridge insertable into a previously installed ventilation apparatus housing having at least one wall and defining an aperture, the upgrade cartridge comprising:

a motor plate dimensioned to be capable of fitting into a previously installed ventilation apparatus housing;

a motor secured to the motor plate and configured and arranged to not extend past some dimensions of the motor plate;

a scroll including a blower outlet defining an outlet opening and configured to interface with the aperture in the main housing and including at least one locating rib configured and arranged to engage the at least one wall to guide the upgrade cartridge into the previously installed ventilation apparatus housing, and a downwardly open hook;

a blower wheel coupled to the motor and positioned within the scroll so as to be capable of generating a fluid flow;

a capacitor electrically connected to the motor, and mechanically coupled to the scroll; and a motor harness including at least one plug, the at least one plug being capable of coupling with at least one plug receptacle.

2. The ventilation apparatus of claim 1 further comprising:

a main housing having a plurality of walls defining an interior space; and an outlet through which a fluid is exhausted from the main housing;

an anchor capable of fastening the upgrade cartridge to the main housing;

an integrated electrical box assembly coupled with the main housing, the integrated electrical box assembly including an electrical box enclosure comprising an electrical box enclosure anchoring tab;

an electrical box cover plate comprising at least one anchor capable of coupling the electrical box cover plate to the electrical box enclosure, and at least one anchor capable of coupling the integrated electrical box cover plate to the main housing;

at least one orifice capable of coupling with at least one duct connector assembly; and at least one plug receptacle, wherein the at least one plug receptacle is capable of interfacing with the at least one plug.

3. The ventilation apparatus of claim 1 further comprising a duct connector assembly, the duct connector assembly comprising:

a ventilation orifice comprising a first end, the first end capable of coupling with a main housing; and a second end, the second end capable of coupling with a ventilation duct of a building;

a damper flap coupled with a ventilation orifice, the damper flap capable of being moved within the ventilation orifice to substantially control the backflow of a fluid into the ventilation orifice and the upgrade cartridge from a ventilation duct of a building; and is further capable of substantially controlling the flow of a fluid from a space into the ventilation duct of a building when the motor is unpowered; and a duct connect snap mounting assembly including a duct connector tab, the duct connector snap mounting assembly capable of coupling the duct connector assembly with a main housing.

4. The ventilation apparatus of claim 3 wherein the diameter of the ventilation orifice is at least 3 inches.

5. The ventilation apparatus of claim 1 the downwardly open hook defining a grille spring holder configured and arranged to couple a grille to the scroll.

6. The ventilation apparatus of claim 1 wherein the scroll further comprises:

at least one upgrade cartridge snap retention feature substantially integrated with the scroll, and capable of coupling the upgrade cartridge to a main housing.

7. The ventilation apparatus of claim 1 wherein the scroll comprises an outermost peripheral wall extending substantially around the perimeter of the blower wheel and an intake wall extending inward from the peripheral wall to define an intake aperture through which air enters the scroll, the downwardly open hook extending from the scroll outermost peripheral wall.

8. The ventilation apparatus of claim 1 wherein the scroll comprises an outermost peripheral wall extending substantially around the perimeter of the blower wheel and an intake wall extending inward from the peripheral wall to define an intake aperture through which air enters the scroll, the downwardly open hook extending from the scroll intake wall.

9. The ventilation apparatus of claim 1 wherein the scroll comprises an outermost peripheral wall extending substantially around the perimeter of the blower wheel, an intake wall extending inward from the peripheral wall to define an intake aperture through which air enters the scroll and the at least one locating rib extending outward from the scroll outermost peripheral wall, the downwardly open hook extending from the locating rib.

10. The ventilation apparatus of claim 1 wherein the scroll comprises an outermost peripheral wall extending substantially around the perimeter of the blower wheel, an intake wall extending inward from the peripheral wall to define an intake aperture through which air enters the scroll and the at least one locating rib comprising a first locating rib and a second locating rib extending outward from the scroll outermost peripheral wall, the downwardly open hook extending from the first locating rib and a second downwardly open hook extending from the second locating rib.

11. The ventilation apparatus of claim 10 wherein the scroll comprises a snap retention feature situated between the first and second downwardly open hooks.

12. The ventilation apparatus of claim 1 further comprising a capacitor electrically connected to the motor, and mechanically coupled to the scroll.

13. The ventilation apparatus of claim 1 further comprising a motor harness including at least one plug, the at least one plug being capable of coupling with at least one plug receptacle.

* * * * *